United States Patent [19]

Garnes

[11] Patent Number: 5,060,996

[45] Date of Patent: Oct. 29, 1991

[54] GOLF BALL SHAG AND CARRYING DEVICE

[76] Inventor: Joseph Garnes, 18307 Puritas Ave., Cleveland, Ohio 44135

[21] Appl. No.: 554,716

[22] Filed: Jul. 18, 1990

[51] Int. Cl.[5] ..... A63B 47/02

[52] U.S. Cl. ..... 294/19.2; 221/309

[58] Field of Search ..... 294/19.2, 99.1; 221/307, 309, 310; 56/328.1; 81/53.11; 224/919; 273/32 D

[56] References Cited

U.S. PATENT DOCUMENTS

| | | | |
|---|---|---|---|
| 713,672 | 11/1902 | Oliver | 294/19.2 |
| 1,658,145 | 2/1928 | Uyei | 294/19.2 |
| 2,027,546 | 1/1936 | Macdonald | 294/19.2 |
| 2,523,942 | 9/1950 | Ciambriello | 294/19.2 |
| 2,526,084 | 10/1950 | Penn | 294/19.2 X |
| 2,706,657 | 4/1955 | Talley | 294/19.2 |
| 2,760,807 | 8/1956 | Watson | 294/19.2 |
| 3,029,097 | 4/1962 | Ward | 294/19.2 |
| 3,136,573 | 6/1964 | Harke | 294/19.2 |
| 3,141,696 | 7/1964 | Nau | 294/19.2 |
| 3,206,067 | 9/1965 | Smith et al. | 294/19.2 X |
| 3,412,897 | 11/1968 | Slater | 294/19.2 X |
| 3,558,170 | 1/1971 | Stanworth | 294/19.2 |
| 3,729,421 | 4/1973 | Gibson et al. | 221/307 X |
| 3,777,933 | 12/1973 | Joliot | 221/309 |
| 3,997,169 | 12/1976 | Bergstrom | 294/19.2 X |
| 4,045,068 | 8/1977 | Nelson | 294/19.2 |
| 4,058,336 | 11/1977 | Parkinson | 294/19.2 |
| 4,088,251 | 5/1978 | Rodriguez | 294/19.2 X |
| 4,629,235 | 12/1986 | Logue | 294/19.2 |

FOREIGN PATENT DOCUMENTS

| | | | |
|---|---|---|---|
| 1429211 | 1/1966 | France | 294/19.2 |
| 682885 | 11/1952 | United Kingdom | 294/19.2 |
| 1125353 | 8/1968 | United Kingdom | 294/19.2 |

*Primary Examiner*—Johnny D. Cherry
*Attorney, Agent, or Firm*—J. Helen Slough

[57] ABSTRACT

The present invention is a combination of a golf ball carrier and a shagger for golf balls where the golf ball can be retrieved from the carrier through the shagger end. The preferred embodiment of this invention is made of a tube slightly larger in diameter than a golf ball with several holes that are large enough for an individual to place his finger through. The tube has four slots at each end of the tube. O-rings of a slightly less diameter than the tube are placed over the ends of the tube and fit in the slot. These rubber o-rings form a mouth at both ends of the tube which has a diameter less than a golf ball. To use the invention, an individual places the tube over a golf ball which he wishes to shag and presses down on the tube. The rubber o-rings will flex outward allowing the golf ball to enter the tube and upon entrance in the tube the o-rings will then flex back into position so that the golf ball will remain in the tube. When an individual wishes to recover a ball from the tube, he sticks his fingers through one of the holes in the tube and puts pressure on the golf balls toward one end. This pressure causes the o-ring to flex outward allowing the golf ball to exit the tube. Once the golf ball has exited the tube, the o-ring will then flex back into position holding any other golf balls in the tube.

1 Claim, 2 Drawing Sheets

GOLF BALL SHAG AND CARRYING DEVICE

FIELD OF THE INVENTION

This invention relates to golf ball shags and devices to carry golf balls.

BACKGROUND OF THE INVENTION

A golf ball shag and carrying device presently on the market consists of a cloth bag attached to one end of an aluminum tube whose diameter is slightly larger than the diameter of a golf ball. At the other end of the aluminum tube, three flexible tabs are disposed on the inside of the tube and said tabs are slanted towards the cloth bag end of the aluminum tube. When the tube is placed over a golf ball, the ball causes the tabs to flex and allows the ball to enter the tube. The golf ball cannot exit at the end of the tube having the tabs due to the slanted construction of the tabs and to the fact that the tabs do not flex outwardly towards the opening. The device is expensive to build and is bulky. An object of the present invention is to produce a golf ball shag and ball carrying device which is inexpensive to manufacture, of light weight, highly efficient in use and adapted for being carried in or on a golf bag or otherwise by the person using the same and suited for use both as a shag and a ball carrier. Still further objects of the invention and the invention itself will become apparent from a consideration of the drawings and specification in which the drawings are referenced.

SUMMARY OF THE INVENTION

This invention involves the use of a plastic tube preferably provided with openings in the tube walls to lighten the same and having yieldable means at either end of the same to enable the tube when desired to pick up and discharge balls. The device hence functions both as a compact shag and ball carrier. The present invention is a combination of a means for carrying a golf ball and a means for shagging the golf ball where the golf ball can be retrieved from the carrier through the means for shagging. The preferred embodiment of this invention is made of a tube slightly larger in diameter than a golf ball with holes in the wall of the tube large enough to admit an individual's finger to exert pressure on a ball to remove the same. The tube has a plurality of four slots at each end of the tube. An o-ring of slightly lesser diameter than the tube is placed over open ends of the tube and is adapted to project through the slot. The o-rings are preferably of rubber, neoprene, or other flexible material and form a mouth at both ends of the tube which mouth has a diameter less than a golf ball. To use the invention, an individual places the tube over a golf ball which he wishes to shag and presses down on the tube whereupon the rubber o-ring at the lower end of the tube flexes outwardly allowing the said golf ball to enter the tube. Upon entrance into the tube, the ball passes the o-ring which flexes back into position within the slots adjacent the entrance of the tube to retain the golf ball in the tube and prevent the same from being dropped out of the tube. When the individual using the ball shag and carrier wishes to remove a ball from the tube, he inserts a finger through one of the holes in the tube to put pressure on an end located golf ball. Such pressure will cause the o-ring to flex outwardly and allow the golf ball to exit the tube. Once the golf ball has exited the tube, the o-ring flexes back into position in the slots holding the remaining golf balls in the tube.

IN THE DRAWINGS

FIG. 1 is a front elevational view of the Golf Ball Shag and carrying device of my invention showing a ball in an operative position;

FIG. 2: is a front elevational view of the Golf Ball Shag and Carrying Device of FIG. 1 showing golf balls positioned therein in different operative positions;

FIG. 3: is a fragmentary view showing the Golf Ball Shag and Carrying Device of FIG. 1 and 2 and showing another operative use of the same;

FIG. 4: is a top plan view of the o-ring shown in FIGS. 1 and 2;

FIG. 5: is a sectional view taken from the line 5—5 of FIG. 1;

FIG. 6: is a sectional view taken from the line 6—6 of FIG. 1;

FIG. 7: is an elevational view taken from line 7—7 of FIG. 1;

FIG. 8: is a sectional view similar to the view of FIG. 7 showing the ball at a different position in the carrier than that shown in FIG. 7;

FIG. 9: is a fragmentary view showing o-ring portions projecting through the slots in the end of the shag and or carrier, a golf ball being in a position of contact with the o-ring to cause portions of the ring to extend through slots in an end of the Golf Ball Shag and Carrier Device;

FIG. 10: is a fractional view showing the o-ring located at an end of the Golf Ball Shag and Carrier to the different positioning of the ball with respect to the o-ring, the Golf Ball Shag and Carrier being in initial contact with respect to the same.

DETAILED DESCRIPTION OF THE PREFERRED EMBODIMENT

Figure 1:
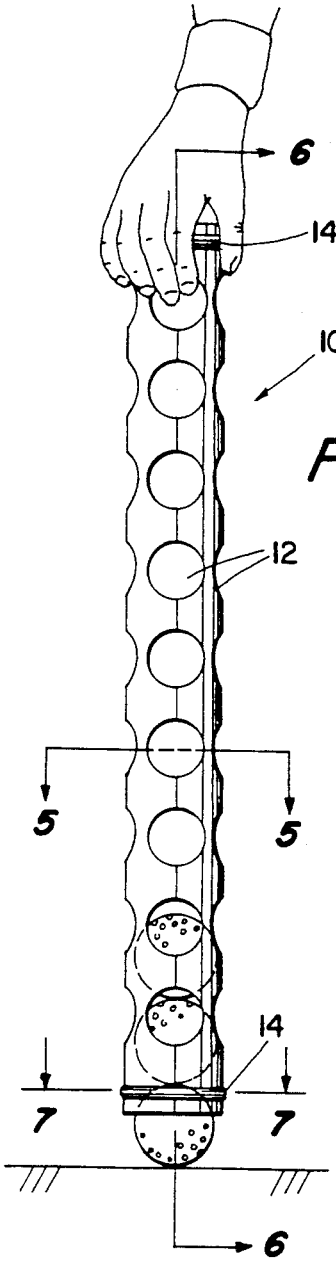

Reference is now made to the Figures, in all of which like parts are designated by like reference characters. In FIG. 1, at 10 a cylindrical tube is shown having spaced openings 12 in the walls thereof. The openings 12 are of a size sufficient to permit the insertion of an individual's fingers therethrough but are less than the diameter of a golf ball. In the preferred embodiment as shown, the spaced openings 12 are provided in the tube about the circumference of the tube and a number of said openings 12 are provided along the length of the tube as desired depending on the length of the tube and limit of the weight thereof. At either end of the tube an o-ring 14 is shown which is adapted to be placed about the circumference of the tube and about elongated spaced slots 18 about the said circumference and spaced inwardly of either end of the tube. The tube 10 is slightly larger in diameter than a golf ball and is provided with spaced openings in the wall thereof. The openings 12 in the preferred embodiment are round, but said openings, it will be evident, may be of any shape or number as long as they provide space for an individual's fingers to enter the same. The openings as stated also are employed to reduce the weight of the tube to provide a light weight shag and ball receiver and dispenser. In the preferred embodiment the tube is constructed of plastic; however, the tube may be of metal, cardboard, or other suitable material.

Figure 2:
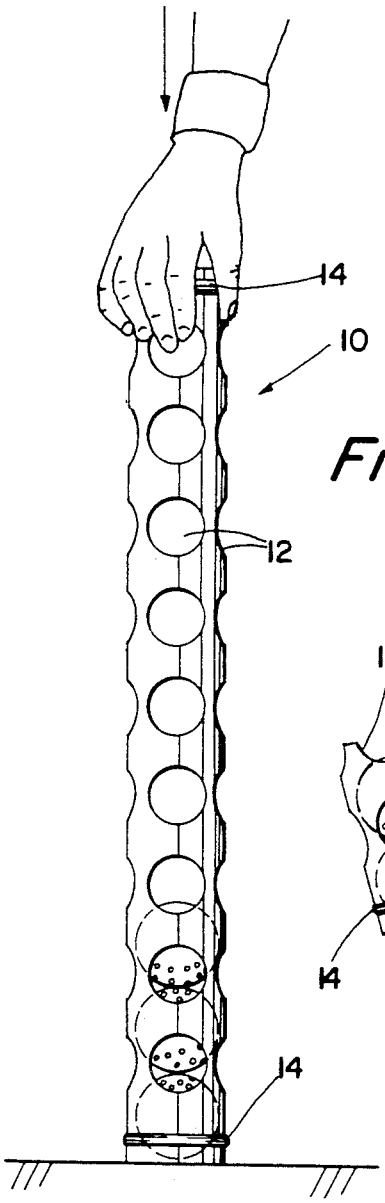
Figure 6:
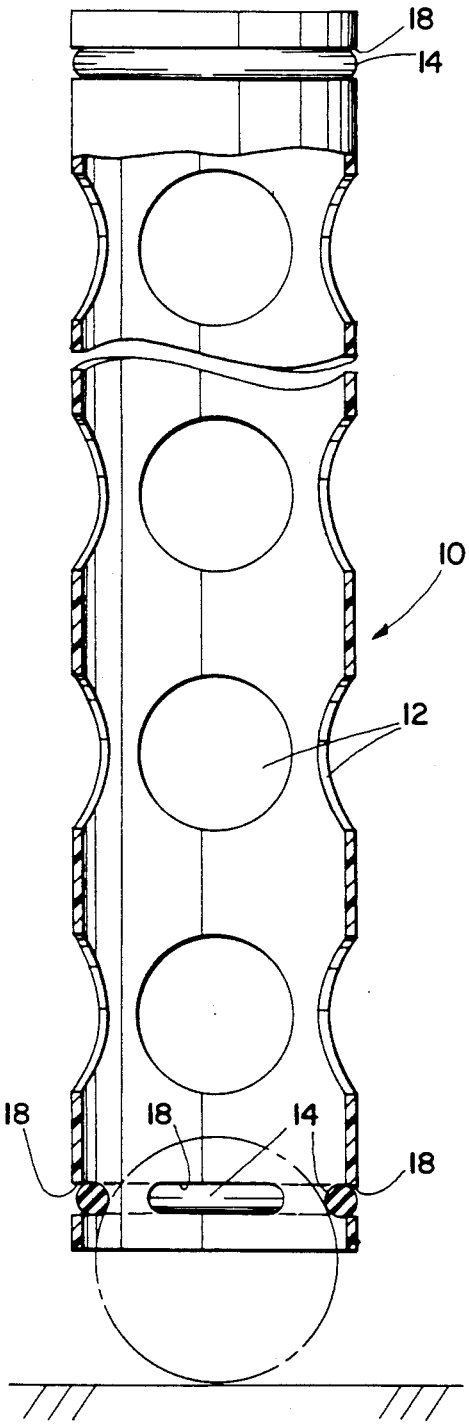
Figure 7:
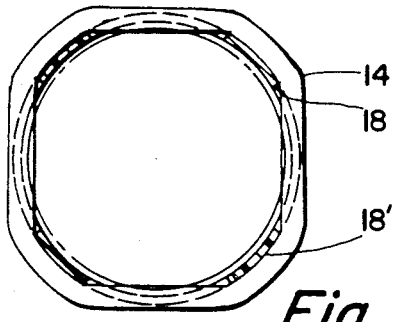
Figure 8:
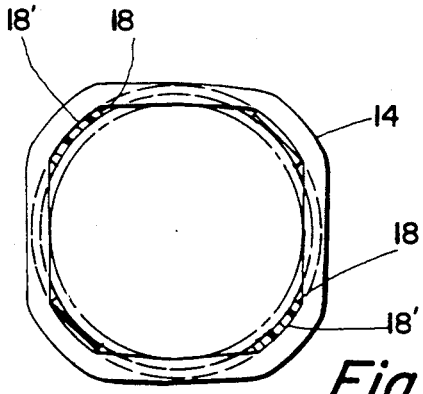
Figure 9:
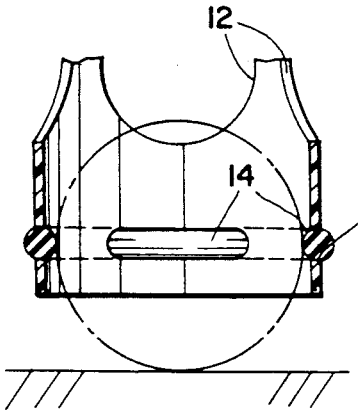
Figure 10:
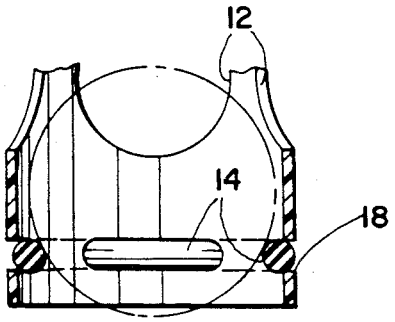

FIGS. 1 and 2 disclose positioning of the o-rings 14 at either end of the tube 10. FIG. 6 discloses placement of the o-rings 14 about both slotted ends of the tube. In the preferred embodiment a plurality of slots 18, namely, four, are provided as shown in FIGS. 7–10 inclusive. The said o-rings 14 which are slightly less than the diameter of the tube are in use placed over the ends of the tubes 10 and fit into the slots 18 as shown in FIGS. 7 to 10. In FIG. 6 an enlarged sectional view of the golf ball shag and carrying device discloses the o-rings 14 producing a mouth on the tube less than the diameter of the tube 10. The o-rings 14 are preferably constructed of a flexible or elastic substance such as rubber, neoprene, or plastic.

Figure 3:
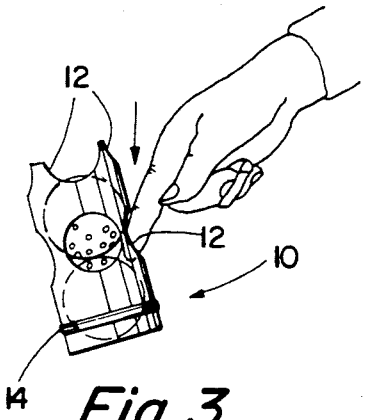
Figure 4:
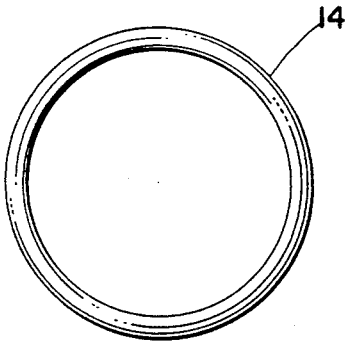
Figure 5:
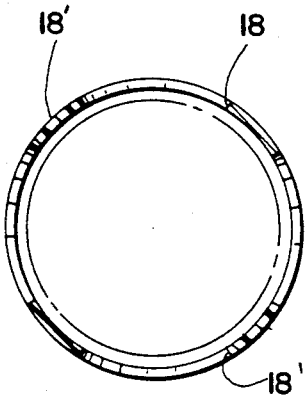

In operation the tube 10 is carried vertically by a golfer and placed over any golf ball which the individual wishes to pick up. To secure the same, the said individual presses down on the tube 10 wherefore the o-ring at the entrance or lowermost end of the tube flexes outwardly by virtue of the pressure erected thereon by the golf ball entering the end of the tube facing the ball which end is surrounded by the "o"-ring. Once a golf ball enters the tube and passes the slots 18 into which the o-rings 14 are pressed, the o-ring 14 flexes back into position into the slot and prevents the golf ball previously introduced into the tube from exiting the tube. Thereafter, to remove a ball from the tube 10, the user inserts a finger through one or more of the holes 12 in the tube 10 as shown in FIG. 3 to exert sufficient pressure on a golf ball adjacent the hole to eject the same from an end of the tube wherefore the ball is caused to press against an o-ring 14 seated in the end of the tube and presses portions of the o-ring 14 in the slots outwardly wherefore the ball may exit the tube. After exit of the ball from the tube, the o-ring 14 at such end immediately flexes back into position and portions thereof enter the slots 18 at the exit end to restrain other balls from being ejected from the tube. It will be obvious that the o-ring can be held in expanded position to discharge more than a selected ball and/or all balls from the carrier. It is thus apparent that golf balls can both be shagged and retrieved by the tube 10.

While I have described this invention in connection with a preferred embodiment, I am aware that numerous and extensive departures could be made therein, such as a variation in length, number of openings, material of the tube and employment of resilient means other than the o-rings without however departing from the spirit of my invention and the scope of the appended claims.

What is claimed is:

1. A golf ball holder and shagging device comprising a cylindrical tube having an opening at an end of the tube of a diameter slightly larger than the diameter of a golf ball, the tube having a plurality of openings in the body of the tube of a diameter slightly less than the diameter of a golf ball, an end of the tube being provided with a plurality of circumferentially disposed spaced slots adjacent said end of the tube, a resilient O-ring of slightly less diameter than the diameter of the tube disposed over said end of the tube and adapted to have portions thereof projected into the tube through said slots to deter a golf ball within the tube from exiting the tube, retrieval of a ball from the said tube being obtained from pressure exerted on a golf ball by placing an individual's finger into the tube by access through an opening in the body of the tube and pressing downwardly on a ball carried within the tube in alignment with said opening, the said pressure causing the said aligned ball to be ejected from the tube past the O-ring which is caused to flex outwardly during the ball's passage thereover and to flex inwardly thereafter to retain any other balls carried in the tube.

* * * * *

UNITED STATES PATENT AND TRADEMARK OFFICE

CERTIFICATE OF CORRECTION

PATENT NO. : 5,060,996

DATED : October 29, 1991

INVENTOR(S) : GARNES, Joseph

It is certified that error appears in the above-identified patent and that said Letters Patent is hereby corrected as shown below:

On the title page: change of address. Item [75]

Please change "18307" to --18303--.

Column 2, Line 53, change "18" to --14'--.

Signed and Sealed this

Third Day of August, 1993

Michael K. Kirk

*Attest:*

MICHAEL K. KIRK

*Attesting Officer*

*Acting Commissioner of Patents and Trademarks*